US005636394A

United States Patent [19]

Bartley

[11] Patent Number: 5,636,394

[45] Date of Patent: Jun. 10, 1997

[54] HOSPITAL BED WITH RACK AND PINION STABILIZER

[75] Inventor: Gary L. Bartley, Kalamazoo, Mich.

[73] Assignee: Stryker Corporation, Kalamazoo, Mich.

[21] Appl. No.: 431,119

[22] Filed: Apr. 28, 1995

[51] Int. Cl.[6] ..... A47B 9/06; A47B 9/10; A47C 17/76

[52] U.S. Cl. ..... 5/611; 108/10; 108/147

[58] Field of Search ..... 5/610, 611, 614; 108/7, 10, 55.3, 71, 76, 84, 95, 96, 105, 106, 130, 177, 187, 147; 74/842; 254/230, 341

[56] References Cited

U.S. PATENT DOCUMENTS

| | | | |
|---|---|---|---|
| 592,226 | 10/1897 | Ingram et al. | 254/230 |
| 605,848 | 6/1898 | Borst | 254/230 |
| 817,907 | 4/1906 | Feist | 254/230 |
| 2,522,759 | 9/1950 | Lindquist | 5/63 |
| 3,253,284 | 5/1966 | St. John | 5/62 |
| 3,581,319 | 6/1971 | Stanley et al. | 5/68 |
| 3,643,604 | 2/1972 | Jones et al. | 5/610 |
| 3,808,613 | 5/1974 | Carpentier et al. | 5/63 |
| 4,038,709 | 8/1977 | Kerwit | 5/68 |
| 4,324,010 | 4/1982 | Houlberg et al. | 5/68 |
| 4,559,655 | 12/1985 | Peck | 5/66 |
| 4,647,015 | 3/1987 | Pusl | 254/230 |
| 4,723,808 | 2/1988 | Hines | 5/610 |
| 5,172,442 | 12/1992 | Bartley et al. | 5/611 |
| 5,370,063 | 12/1994 | Childers | 108/143 |
| 5,408,940 | 4/1995 | Winchell | 108/10 |
| 5,450,800 | 9/1995 | Leonard | 108/7 |

FOREIGN PATENT DOCUMENTS

| | | | |
|---|---|---|---|
| 0516089 | 12/1992 | European Pat. Off. | 5/611 |
| 516089 | 12/1992 | European Pat. Off. | 5/611 |
| 2191873 | 2/1974 | France . | |
| 1766522 | 7/1970 | Germany | 5/610 |

*Primary Examiner*—Steven N. Meyers
*Assistant Examiner*—Robert G. Santos
*Attorney, Agent, or Firm*—Flynn, Thiel, Boutell & Tanis, P.C.

[57] ABSTRACT

A hospital bed including a base adapted to roll over the floor, a litter disposed on the base upon which the patient rests, a lift assembly designed to selectively position the litter a selected vertical distance above the base and at least one stabilizer unit between the litter and the base. Each stabilizer unit includes a pair of rack-and-pinion assemblies that extend between the base and the litter. The pinions of the rack-and-pinion assembly are connected together to rotate in unison. Owing to the interconnection of the pinions, the rack-and-pinion assemblies are prevented from moving vertically in directions opposite to each other. This lock-out of the rack-and-pinion movement prevents the litter from moving side-to-side. The stabilizer unit thus prevents the undesirable side-to-side rocking movement of the litter.

26 Claims, 9 Drawing Sheets

HOSPITAL BED WITH RACK AND PINION STABILIZER

FIELD OF THE INVENTION

This invention relates generally to hospital beds and, more particularly, to a hospital bed having stabilizers designed to substantially eliminate side-to-side rocking motions which can be disconcerting to a patient.

BACKGROUND OF THE INVENTION

Hospital beds have evolved into complicated assemblies that, in many instances, provide therapeutic relief to patients that use them. A typical hospital bed includes a base designed to roll on the floor and a litter upon which the patient rests. A lift assembly, which often includes one or two jacks, connects the litter to the base so that litter can be raised or lowered as may be required for the convenience of the patient, the patient's medical condition, or to allow a specific medical procedure to be performed on the patient. Many hospital bed lift assemblies are also designed to selectively move one end of the litter so that either the head end or foot end of the litter can be elevated relative to the other end so as to incline the litter. The ability a modern hospital bed has to lift a patient up and down and to position the patient in an inclined position has been found to help individuals suffering from, shock, certain cardiac conditions and other medical ailments.

Many hospital beds are designed so that the lift assembly includes two jacks each of which extends between a separate end of the base and the adjacent end of the litter. Typically a hospital bed jack has a base unit that is secured to the bed base and a telescoping piston arm that extends between the base unit and the underside of the litter. Many of these jacks are hydraulically driven. The drive units used to actuate these jacks are arranged to raise the jacks in unison and further designed to individually lower them so that the litter unit can be inclined as desired. On many hospital beds the jacks are spaced as widely apart as possible in order to facilitate the placement of medical equipment below the litter so that it can be located underneath the patient. For example, it is desirable to have a space free below the patient in order to facilitate the positioning of X-ray receiving equipment underneath the patient.

While present hospital beds have proved to be useful devices that can ease a patient's hospital stay and offer some therapeutic relief, they are not without some disadvantages. When the telescoping jack piston arms are extended, they have a tendency to wobble around the base units to which they are attached. This jack wobble reduces the stability of the litter. Consequently, when uneven loads are applied to the litter, as can happen when the patient moves to one side of the litter or another individual presses down on a side of the litter, the litter may rock from side-to-side. Litters have also been known to rock when a hospital bed is used as a stretcher to move a patient from one location to another. In these situations, the movement of the bed sometimes causes the litter to develop a back-and-forth harmonic rocking motion. Whatever the cause, this rocking motion has been found to be disconcerting to patients.

Moreover, when a jack piston arm wobbles, it sometimes becomes stuck to the adjacent surfaces of the jack base unit in which it is housed. This situation typically occurs when the piston arm is fully extended and its range of side-to-side movement is at a maximum. Once the piston arm becomes stuck, it may not automatically retract when the jack is lowered. When this occurs, medical personnel have to spend time shifting the litter in order to free the piston arm so that the arm will return to its retracted position. Patients lying in their beds while the jacks are being freed have found this activity to be disquieting.

A number of solutions have been tried to minimize jack wobble and the disconcerting litter rocking that it causes. There have been attempts to cure this problem by providing jacks with relatively large diameter piston arms. While there is less rocking associated with these arms, they are quite costly to install. Moreover, these relatively large jacks significantly add to the overall weight of the hospital bed which, in turn, has made moving these beds more difficult. Another disadvantage of these assemblies is that the larger-sized jacks form larger obstructions that restrict the ability to place medical equipment below the litter underneath the patient.

Another solution to the problem of litter rocking has been to assemble the jacks from components that have very tight tolerances. By so assembling the jacks, it has been found that the piston arms move less and the litter rocking is dampened. Again though, it has however proved very costly to provide these components. Moreover, over time, the components forming these jacks start to wear. Once this occurs, the components lose their tight tolerances relative to each other and the jack piston arms start to develop a noticeable wobble.

Still another method that has been employed to reduce litter rocking has been to provide jacks with telescoping members that have clearances that can be selectively screw adjusted relative to each other. Once these members are set, there is a reduction in litter rocking. However, over time, the screw adjustment components become worn and their litter stabilizing capabilities decrease. Consequently, it becomes necessary to reset the screw adjustment components so that the telescoping members maintain the desired clearances relative to each other. The need to have to perform these readjustments adds to the workload of hospital maintenance personnel. Moreover, eventually, the screw adjustment components of these jack assemblies completely wear out. Once this occurs, the ability of these jacks to inhibit litter rocking is significantly reduced. Also, as before, it has proven expensive to provide the components required to assemble these jacks.

SUMMARY OF THE INVENTION

This invention relates to a new and useful hospital bed which can be used to provide enhanced therapeutic care and comfort to a patient. More specifically, this invention relates to a hospital bed designed to substantially eliminate the problem of litter rocking. The hospital bed of this invention includes a base and a litter that is supported by the base. A lift assembly is provided that includes at least one jack that connects the litter to the base so that the litter can be selectively vertically positioned and inclined. The hospital bed of this invention further includes at least one stabilizing unit that is connected between the litter and the base that is designed to eliminate the lateral rocking of the litter along its longitudinal axis. Each stabilizing unit includes a pair of rack and pinion assemblies that are located on opposed sides of the longitudinal axis of the bed. A connecting tube mechanically couples the individual rack-and-pinion assembly pinions so that the pinions rotate in unison.

In one preferred version of the invention, the bed has two stabilizing assemblies, one located at each end of the bed. Each rack-and-pinion assembly has an upper rack that extends downward from the litter and a lower rack that extends upward from the base. The pinion of these assemblies is disposed between the racks so as to be able to float in position as a function of the positions of the racks relative to each other.

When a force is imposed on just one side of the hospital bed of this invention, the natural tendency of the litter would be to rock downward on the side along which the force is imposed. This downward movement would cause a like motion of the racks on the side of the bed moving downward and an upward movement of the racks attached to the opposite side of the bed. However, since the pinions fitted to the racks can only rotate in unison, the pinions lock out the movement of the racks so as to in turn, stop the bed from rocking.

An advantage of the hospital bed of this invention is that the stabilizing unit serves as an elegant mechanism for substantially eliminating litter rocking. Consequently, the need to provide the bed with other, costly assemblies to perform the same function, such as oversized jacks, tightly fitting components, and/or manually locked components is likewise eliminated. Another advantage of this invention is that the stabilizer unit is relatively small in size. It is thus possible to provide the bed with two stabilizer units and place them in locations, adjacent the jacks, where they will not interfere with the placement of medical equipment below the litter underneath the patient.

Still an additional positive feature of this invention is that the pinions are able to travel up and down along the entire length of the associated racks. This features of the hospital bed provides the stabilizer unit with a relatively wide range of vertical extension. This allows the litter of the hospital bed of this invention to be moved through and locked in the same vertical and inclined positions as other hospital beds that are not provided with anti-rocking mechanisms of like economy and utility.

BRIEF DESCRIPTION OF THE DRAWINGS

This invention is pointed out with particularity in the claims. The above and further advantages of this invention may be better understood by referring to the following description taken in conjunction with the accompanying drawings, in which:

DETAILED DESCRIPTION

Figure 1:
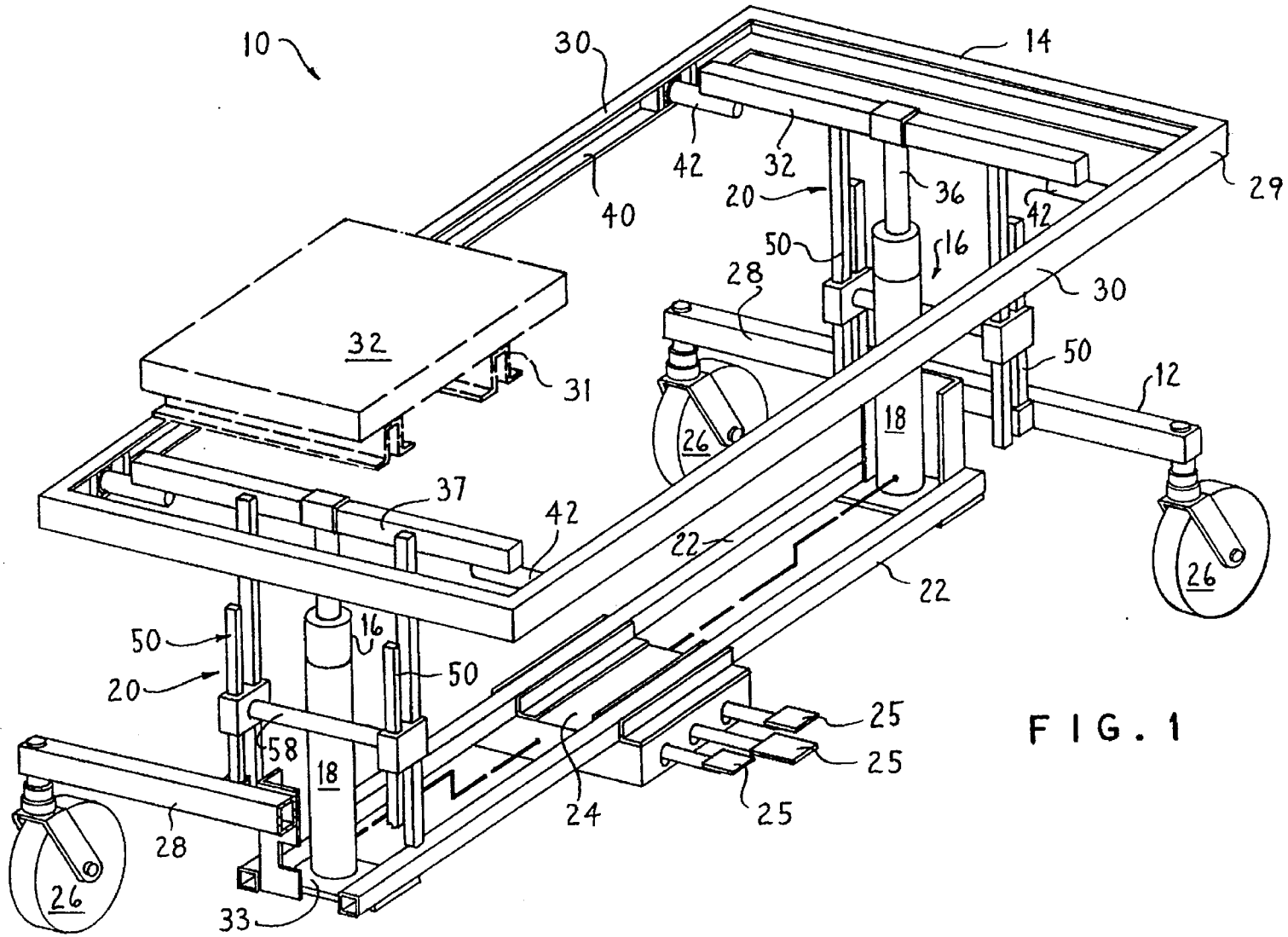
FIG. 1 is a perspective view of a hospital bed of this invention.

FIG. 1 illustrates a hospital bed 10 of this invention. Bed 10 includes a base 12 that can be rolled over a floor surface and a litter 14 attached to the base 12 upon which the patient rests. A lift assembly 16 connects the litter 14 to the base 12 so as to allow the litter to be vertically positioned relative to the base. In the depicted version of this invention, the lift assembly 16 includes two hydraulically actuated jacks 18. Each jack 18 extends between one end of the base 12 and the adjacent end of the litter 14. The jacks 18 are designed to be raised and lowered together and/or individually. This ability to selectively actuate the jacks 18 allows the litter 14 to be raised to a selected position and, if desired, selectively inclined. A pair of stabilizing units 20 extend between the litter 14 and the base 12. Each stabilizer unit 20 is attached to a separate end of the bed and extends across the longitudinal axes of base 12 and litter 14.

The base 12 includes a pair of parallel, spaced apart, rectangular-profile base tubes 22 that extend substantially the length of the bed 10. The base tubes 22 form the primary frame members for the base 12. A hydraulic drive unit 24, known in the technology, is attached to the base tubes and provides a mechanism for actuating the jacks 18. The drive unit 24 has three foot pedals 25. In some versions of the invention, the middle pedal 25 is depressed to raise the jacks 18 simultaneously; the pedals 25 on either side of it are depressed to lower the adjacent jack 18. Litter 14 is inclined by raising the jacks 18 together and then lowering the jack adjacent the end of the patient that should be lowered. Four casters 26 are attached to the base 12 provide the bed 10 with mobility. More specifically, two of the casters 26 are mounted to the opposed ends of a first rectangular profile caster tube 28 that is attached to the base tubes 22 at one end of the base 12. The remaining two casters 26 are attached to a second caster tube 28 that is attached to the base tubes 22 at the opposed end of the base 12. Caster tubes 28 are dimensioned to space the casters 26 a sufficient distance apart so that the base 12 provides a stable platform for the litter 14. In a preferred bed design, caster tubes 28 are further dimensioned so that the casters 26 are located underneath the litter so that they do not pose as obstacles to persons walking near the bed 10.

Litter 14 includes a litter frame 29 that is the actual structure element of the litter that is attached to the jacks 18. The litter frame 29 is a rectangular skeletal assembly that is formed out of a number of frame beams 30 and 31. A support panel 32 mounted to the center of the frame 29 serves as the actual surface of the litter 14 for supporting a mattress and a patient. Many hospital beds 10 are designed so that the support panel 32 is composed of multiple sections that are hingedly connected along lines perpendicular to the longitudinal axis of the bed. One or more of these individual sections is capable of moving relative to the other sections to facilitate a specific positioning of the body of the patient. Linkage members and actuators, not illustrated, mounted to the litter frame 29 are employed to move the individual sections of the support panel 32 in position and lock them in place.

Figure 2:
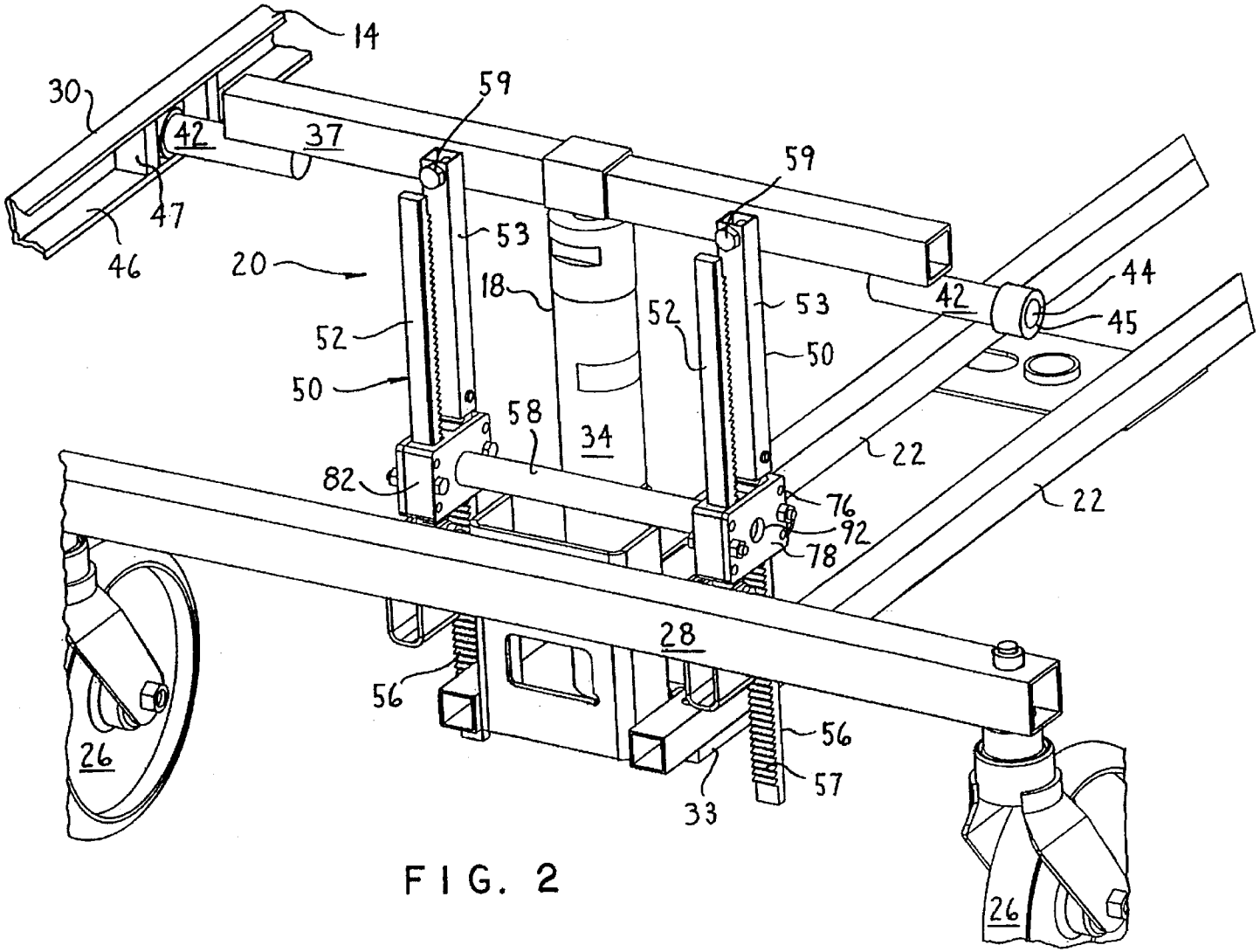
FIG. 2 is a perspective detailed view of one end of the hospital bed illustrating a jack and a stabilizing unit.
Figure 6:
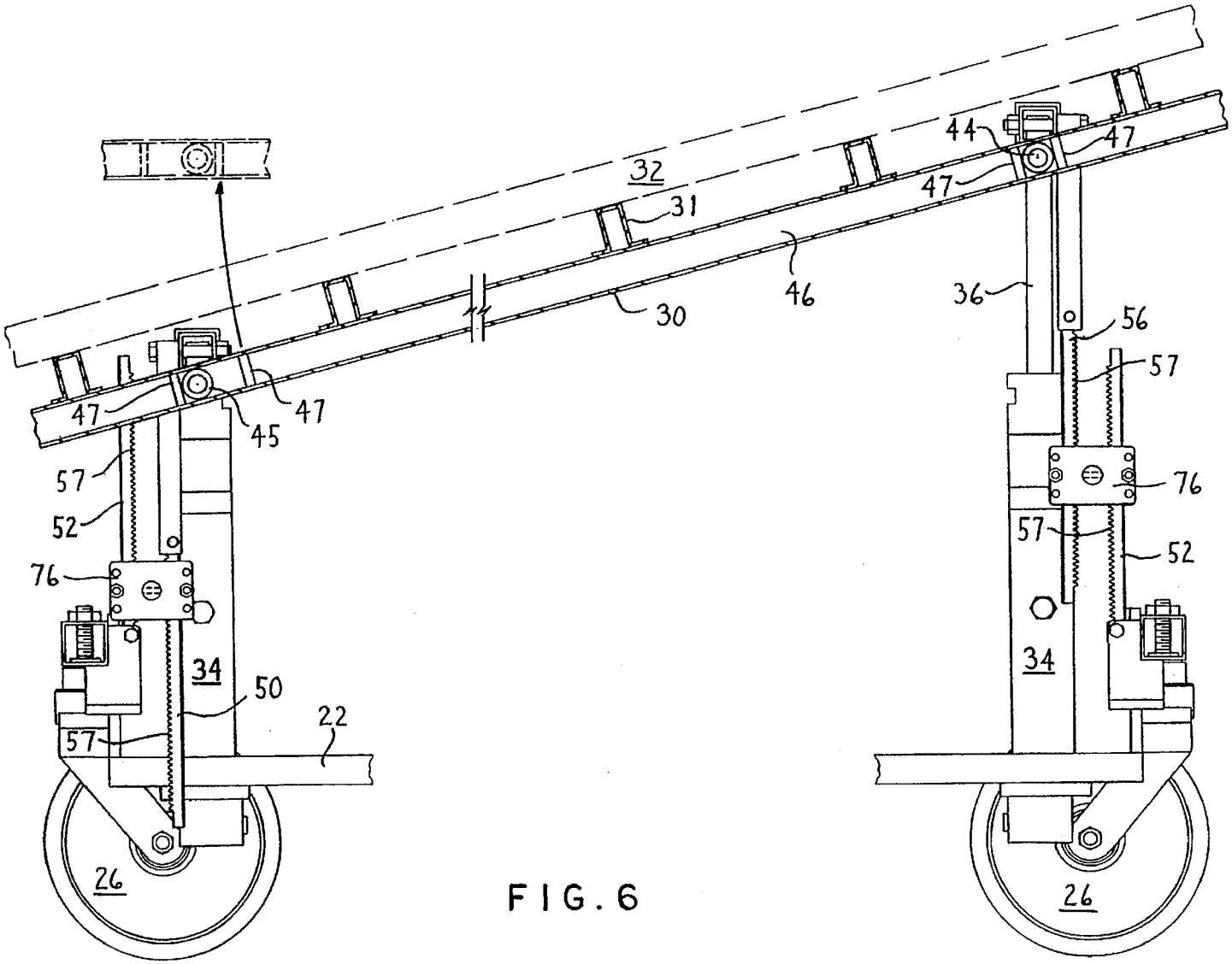
FIG. 6 is a compressed side view illustrating how the litter can be selectively inclined.

Each jack 18 includes a generally cylindrical jack base unit 34, best seen in FIG. 2, that is secured at its lower end to a support plate 33 that extends between base tubes 22. A piston (FIG. 6) disposed in the jack base unit 34 has a piston arm 36 that extends upward from the top of the base unit a selected distance depending upon the actuation of the jack 18. A header tube 37 having a rectangular profile is mounted to the top of the piston arm 36 and is oriented to extend perpendicularly across the longitudinal axis of the bed 10.

Figure 3:
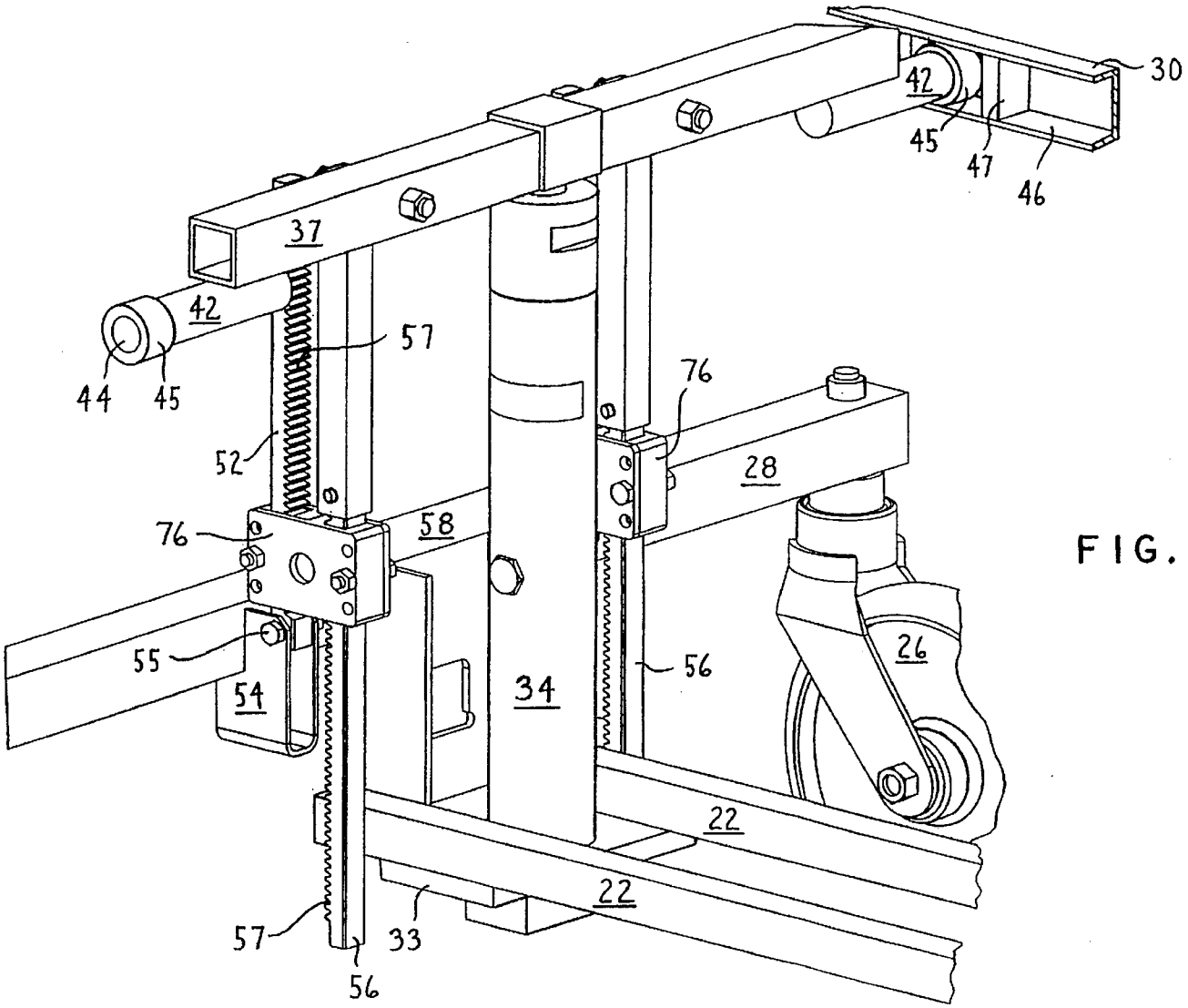
FIG. 3 is a perspective view of the stabilizing unit of the hospital bed when viewed from under the litter.
Figure 4:
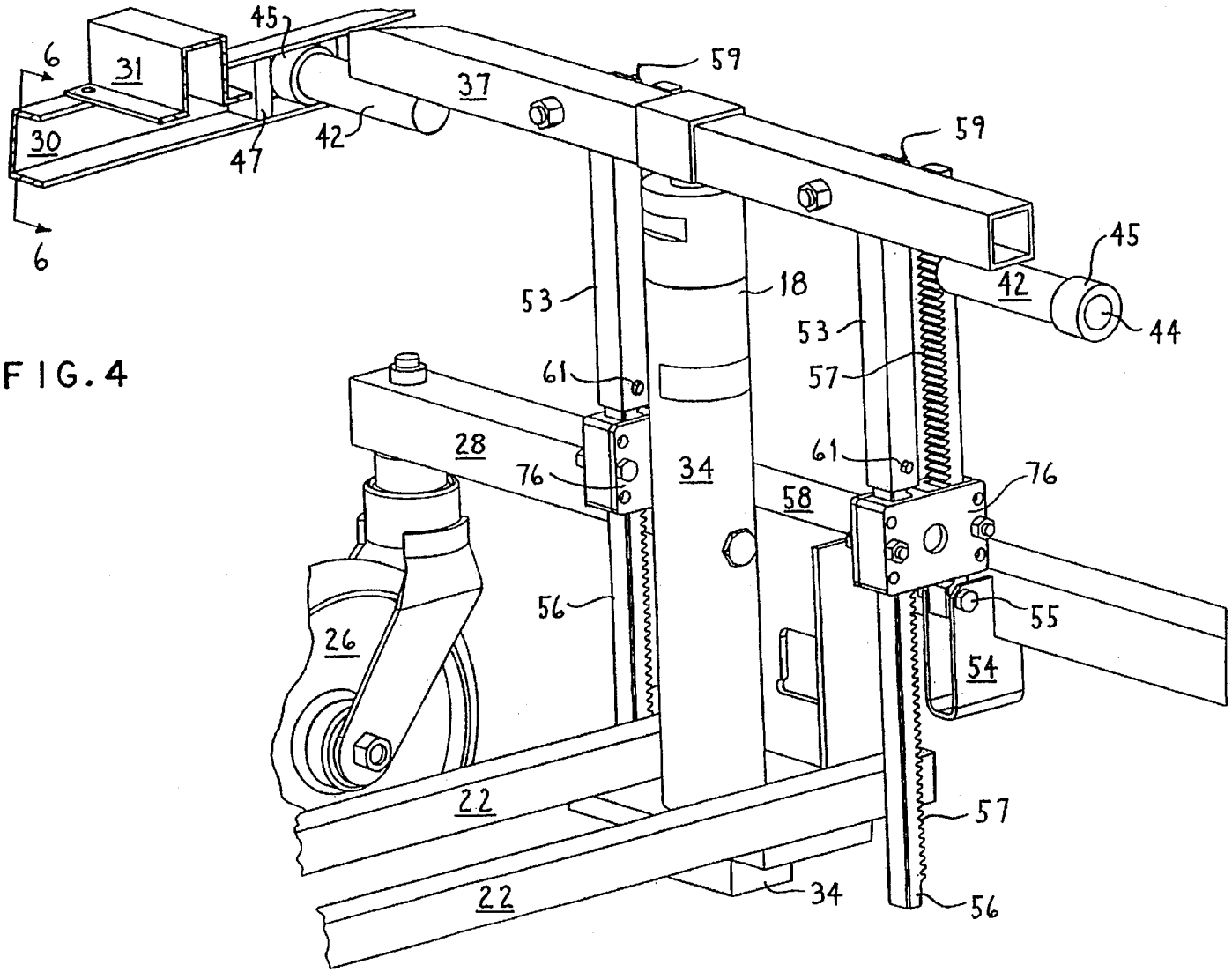
FIG. 4 is another perspective view of the stabilizing unit.
Figure 5:
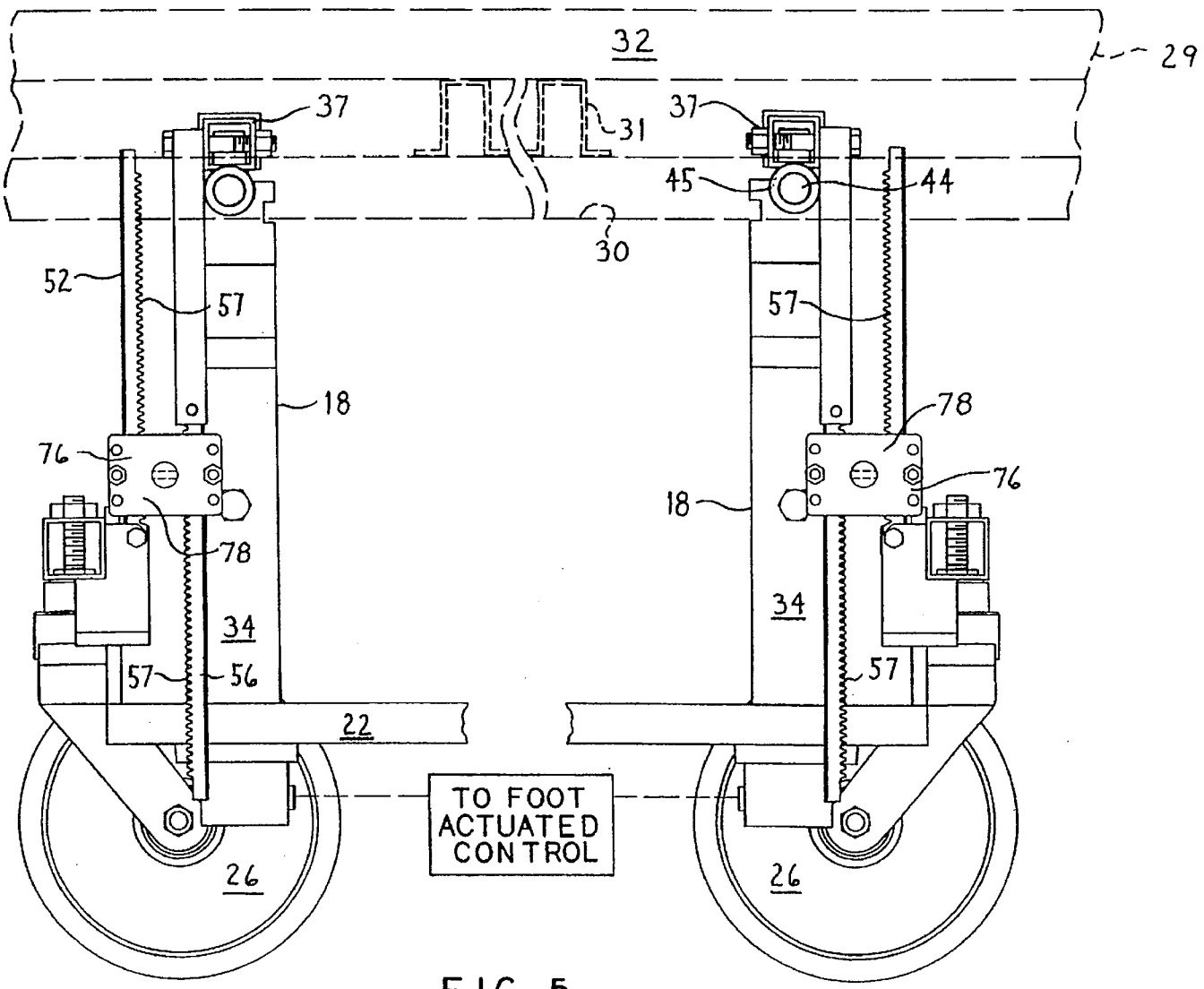
FIG. 5 is a compressed side view illustrating the hospital bed showing the bed when the litter is positioned parallel to the base.

Jack 18 is connected to the adjacent end of the litter 14 by load cells 42 attached to an opposed end of the jack header tube 37 and illustrated in FIGS. 3 and 4. The load cells 42 are solid cylindrical members that are attached to the ends of the header tube 37 so as to extend outwardly away from the header tube 37. Each load cell 42 has a solid cylindrical boss 44 integrally and coaxially formed therewith that extends toward an adjacent longitudinally extending litter frame beam 30. Load cells 42 are formed such that the bosses 44 have an outside diameter smaller than the outside diameter of the main bodies of the cells. Plastic sleeves 45 are fitted over the bosses 44 so as to function as low friction rollers.

The load cells 42 are positioned so that the bosses 44 and sleeves 45 extend into channels 46 defined by the adjacent litter frame longitudinally extending beams 30. More particularly, the litter frame longitudinally extending beams 30 are formed to have a generally U-shaped profile so as to define the channels 46 that are open sideways for receiving the ends of the load cells 42. As best seen by reference to FIG. 6, partition plates 47 secured in the beams 30 that extend across the channels 46 limit the movement of the load cells 42. A first set of partition plates 47 are fitted to the beams 30 so that they are closely located on either side of load cells 42 located adjacent one end of the litter 14, the head end. These partition plates 47 block all substantial movement of the adjacent load cells 42. A second set of partition plates 47 are positioned in the channels 46 to be spaced some distance from the load cells 42 fitted in the channels at the opposed end of the litter 14, the foot end. The spacing of the partition plates 47 from the load cells 42 at the foot end of the litter 14 allows the litter to shift horizontally relative to the adjacent jack 18 when inclined.

Each stabilizer unit 20, now described with reference to FIGS. 2–4, includes a pair of rack-and-pinion assemblies 50 that are located on opposed sides of the longitudinal axis of the bed 10. Each rack-and-pinion assembly 50 includes an upwardly extending lower rack 52 that is attached to the caster tube 28, a downwardly extending upper rack 56 that is attached to the header tube 37 and a pinion 60 (FIG. 9) that is disposed between the racks so as to mechanically connect the racks. The pinions 60 are connected together by a transverse tube 58 to rotate in unison.

The lower and upper racks 52 and 56, respectively, are identical in shape and size. The racks 52 and 56 are formed with linearly extending toothed surfaces 57 to facilitate the engagement of the racks with the pinions 60. In the illustrated version of the hospital bed 10 of this invention, each lower rack 52 is connected to the associated caster tube 28 by a mounting bracket 54. Each bracket 54 is a generally U-shaped member that is further formed to define a notch so as to facilitate the securing of the bracket by welding or other appropriate means to the lower and inside surfaces of the caster tube 28. The lower rack 52 is secured to the mounting bracket 54 by a bolt 55 that extends through the coaxial openings in the bracket and rack, openings not illustrated. In the preferred versions of the invention, the lower rack 52 is loosely secured to the mounting bracket 54 so as to allow the lower rack a small amount of longitudinal sway.

A rectangular-profile extender tube 53 that projects downward from the header tube 37 functions as the suspension link between the header tube and the upper rack 56. In the depicted version of the invention, a bolt 59 that extends through coaxial openings in the extender tube 53 and the header tube 37 is employed to secure one end of the extender tube 53 to the header tube 37. A pin 61, such as a spring pin, extends through openings in the extender tube 53 and the upper rack 56 to secure the upper rack 56 to the extender tube.

Figure 9:
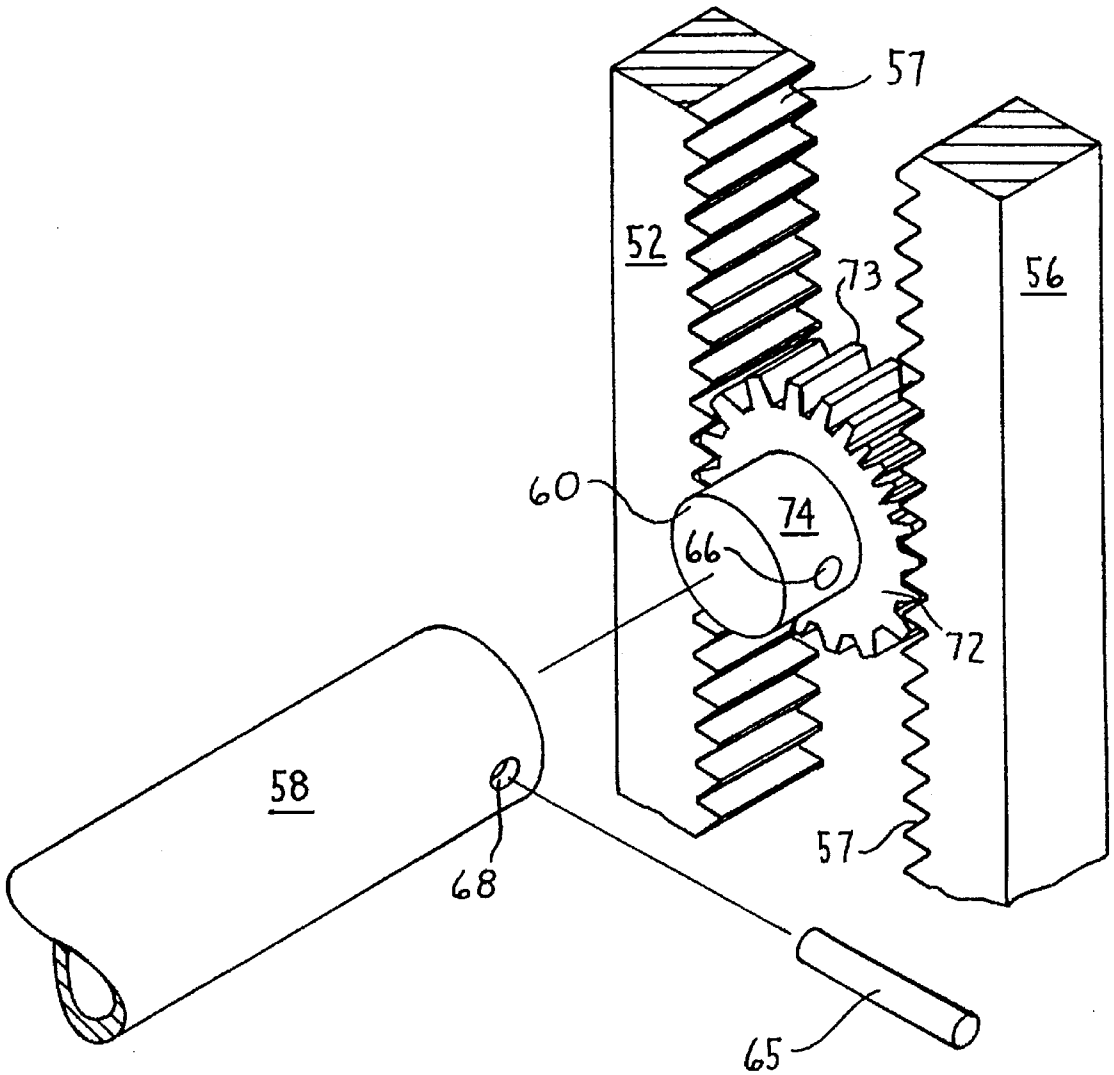
FIG. 9 is an exploded view depicting how a pinion is coupled to the transverse tube.

As shown in detail in FIG. 9, pinion 60 is formed of a single piece of metal and is shaped to form a solid generally cylindrical pinion body 72. Pinion 60 is further shaped so that pinion body 72 has longitudinally extending teeth 73 around its circumferential outer surface that are dimensioned to engage the toothed surfaces 57 of the opposed racks 52 and 56. A pinion boss 74 extends outwardly from one end of the pinion body 72 and is coaxial with the body.

Figure 8:
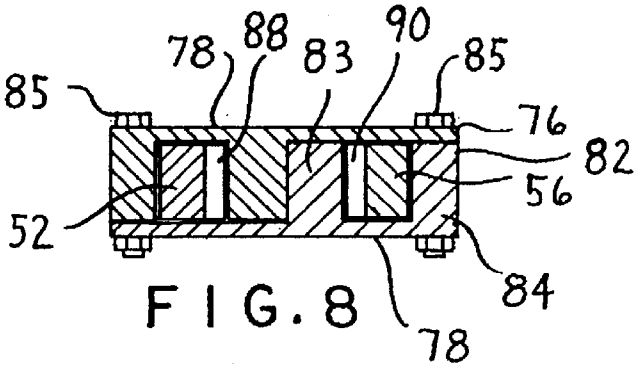
FIG. 8 is a top view of the pinion housing taken along line 8—8 of FIG. 7.
Figure 7:
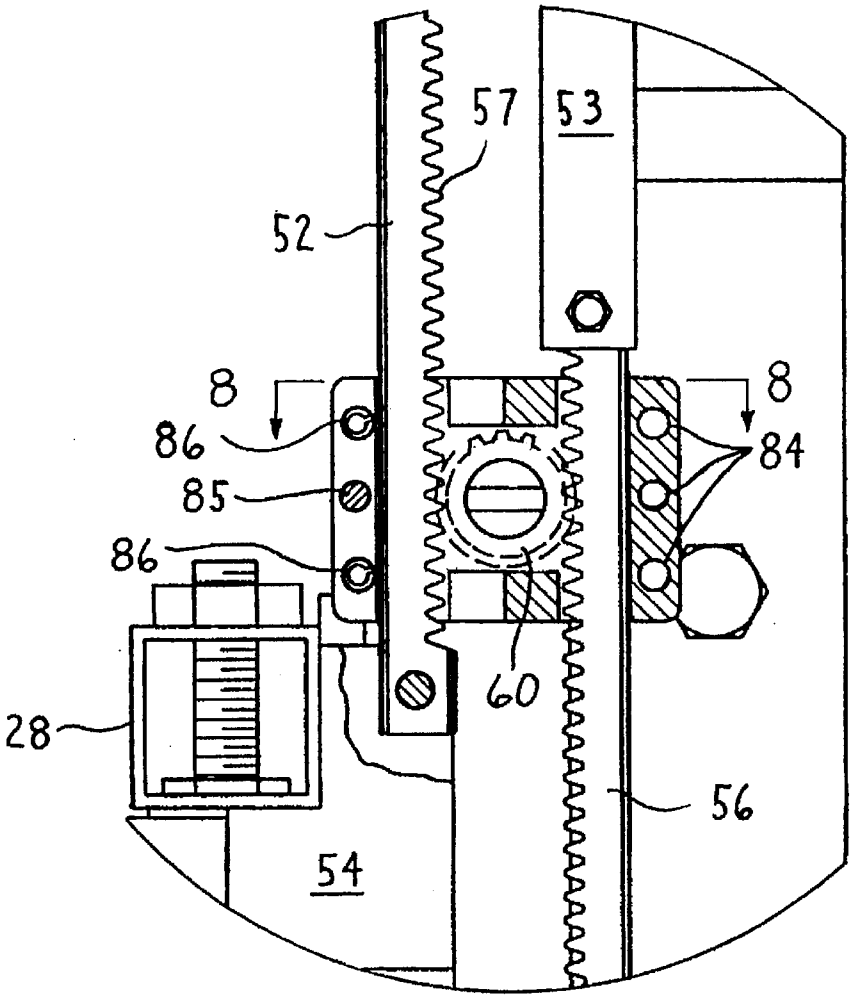
FIG. 7 is a side view illustrating the relationship between the racks and pinion of a stabilizing unit.

Each pinion 60 is contained in a housing 76, now described by reference to FIGS. 2, 7 and 8, through which the lower and upper racks 52 and 56, respectively, extend. Housing 76 is formed out of a pair of identically shaped rectangular housing plates 78. Each housing plate 78 includes a block 82 that extends perpendicularly outward from one end of the plate. The opposed ends of the housing plates 78 are formed with three linearly aligned openings 84 to facilitate the instillation of fastening and aligning members as described below. At one end of each plate 78 the openings 84 extend through the plate block 82. Each housing plate 78 further includes a pair of opposed tabs 83 that extend outward from the longitudinal edges of the plate 78. Tabs 83 are spaced from the blocks 82 to define openings 88 and 90 in the housing 76 through which the racks 52 and 56 extend and that cover the exposed sections of the pinion 60. The housing plates 78 are further shaped to define an opening 92 in the main body through which the pinion boss 74 extends. Bolts 85 extend through the center located plate openings 84 to secure the individual housing plates 78 together. Spring pins 86 extend through the upper and lower plate openings 84 to hold the plates 78 in alignment when they are stressed by the opposing forces of the racks 52 and 56.

The transverse tube 58 has a circular cross sectional profile to facilitate the seating of the ends of the tube over the opposed pinion bosses 74 as seen by reference to FIG. 9. Transverse tube 58 is secured to the pinion 60 by a bolt 65 that passes through openings 66 and 68 formed, respectively, in the pinion boss 74 and in the end of the transverse tube.

The lift assembly 16 of the hospital bed 10 of this invention makes it possible to selectively raise and lower the height of the litter 14 relative to the base 12. Once the litter 14 is raised, the jacks 18 can be individually lowered to incline the litter so it is in a position that offers the patient the most comfort and/or therapeutic benefit.

The stabilizer assembly 20 of the hospital bed 10 of this invention is configured so that the lower racks 52 remain vertically stable relative to the base 12. The upper racks 56 move vertically with the displacement of the end of the litter 14 to which they are attached. When the litter 14 is raised or lowered, the displacement of the upper racks 56 causes a like upward movement in the pinions 60, the pinion housing 76 and the transverse tube 58. Thus, as depicted best by FIG. 6, since the pinions 60 are free to move along the length of the racks 52 and 56, the presence of the stabilizer unit 20 does not effect the normal raising, lowering or inclination of the litter 14.

The interconnection of the stabilizer unit pinions 60, however, locks out movement of the pinions and the associated upper racks 56 unless the racks 56 move in the same direction simultaneously. Thus, when a force is applied to one side of the litter 14 one would normally expect the litter to rock to that side so as to cause the upper racks 56 on that side of the litter to move downward and the upper racks 56 on the opposite side of the litter to move upward. This bi-directional movement of the upper racks 56 is, however, blocked by the pinions 60 which are themselves limited to rotation in a common direction owing to the connection of the transverse tube 58 between them. Consequently, since the upper racks 56 are prevented from bi-directional movement, the racks 56 prevent the litter 14 from shifting from side to side. The bed 10 of this invention thus offers a litter 14 that can be raised, lowered and inclined and that is also stabilized to block the side-to-side rocking that patients find discomforting.

The stabilizer unit 20 of the bed is formed out of a relatively few parts. The lower and upper racks 52 and 56, respectively are identical to each other and the pinion housings 76 are formed out of two identically shaped housing plates 78. Thus, the stabilizer unit 20 of this invention is relatively economical to assemble. Moreover, the incorporation of the stabilizer unit 20 into the bed 10 eliminates the need to provide the bed with other more complicated and costly litter stabilizing mechanisms.

For example, in the past it has been necessary to provide jacks with relatively wide piston arms, arms having diameters of approximately 2 inches, in order to stabilize a bed litter. With this invention, it is now possible to provide the bed 10 with jacks 18 that have piston arms 36 with a diameter of 1 inch or less, (in preferred embodiments of the invention, a diameter of approximately 0.875 inches,) since the litter rocking is blocked by the stabilizer unit 20.

The stabilizing unit 20 of this invention is further designed to have a relatively narrow cross-sectional profile and is constructed to be attached to the end of the bed 10. These features of the stabilizing unit 20 allow it to be installed on the bed so that it is spaced away from the portion of the litter 14 on which the patient rests. Thus, the incorporation of this stabilizing unit does not adversely effect the ability to place medical equipment underneath the patient when the litter 14 is in the raised position.

Figure 10:
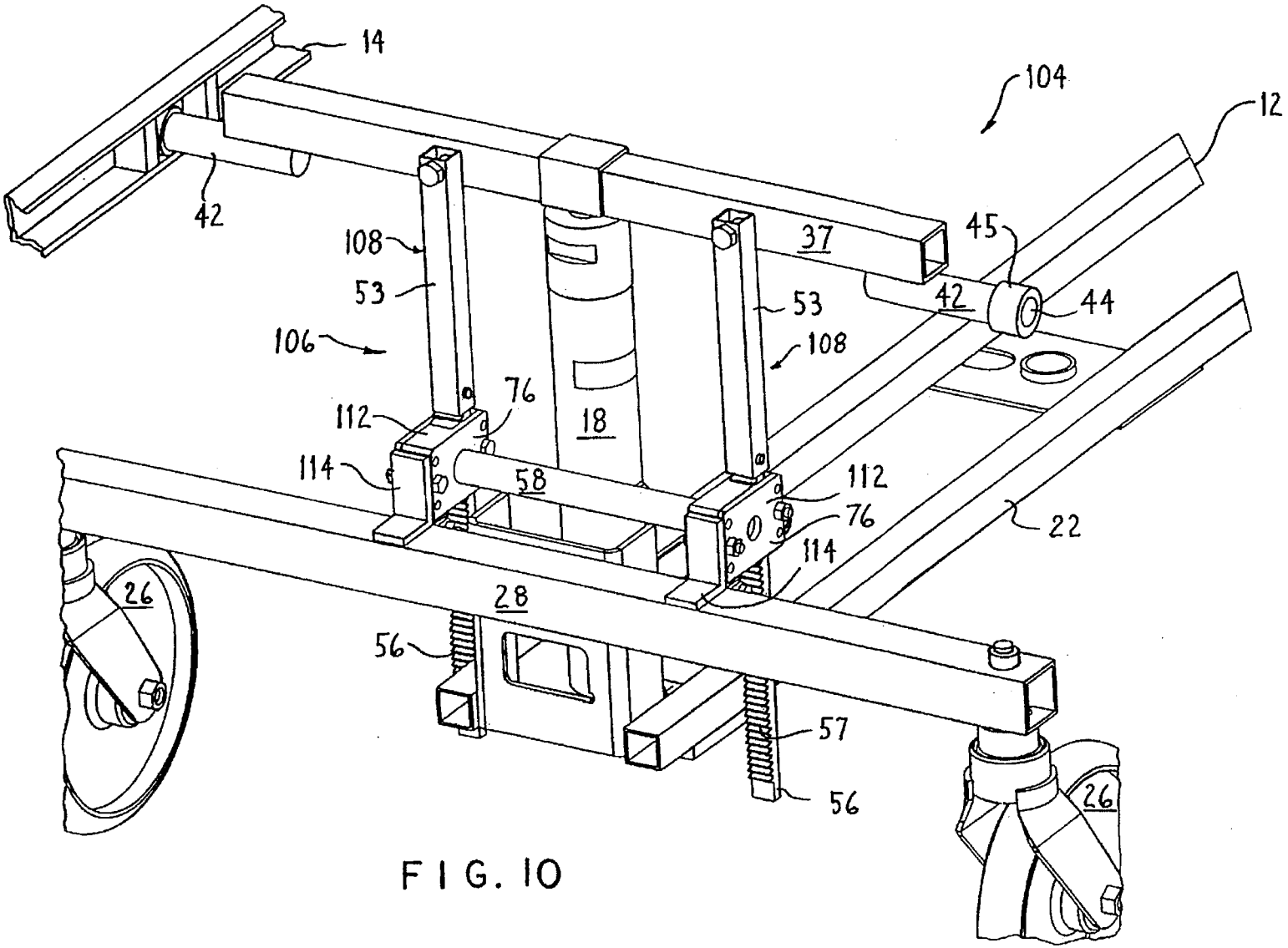
FIG. 10 is a perspective view of one end of an alternative embodiment of a hospital bed of this invention.

FIG. 10 illustrates an alternative embodiment of a hospital bed 104 of this invention. Bed 104 includes the base 12, the litter 14 and jacks 18 (one shown) as previously described. A stabilizing unit 106 is attached to one end of the bed 104. The stabilizing assembly 106 of this version of the invention includes two rack-and-pinion assemblies 108. The rack-and-pinion assemblies 108 extend between the end of the base and the adjacent end of the litter and are located on opposed sides of the longitudinal axis of the bed 104.

Each rack-and-pinion assembly 108 includes previously described upper rack 56 which is suspended downward from the litter 14 by an extender tube 53. A pinion 60 engages the toothed surface 57 of the rack 56. The pinion 60 is disposed in a housing 112 approximately similar in shape and size to previously described housing 76 (FIG. 8). The housing 76 is secured to the base 12 at a fixed location by an L-shaped bracket 114 that is attached to the caster tube 28. A transverse tube 58 extends across the longitudinal axis of the bed 104 to couple the pinions 60 together so that they rotate in unison.

The interconnection of the pinions 60 of this embodiment of the invention has the same effect as their interconnection in the previously described embodiment, namely, it serves to prevent the upper racks 56 from engaging in simultaneous bi-directional movement. Thus this stabilizer unit 106 serves to prevent the litter from rocking side-to-side when it is subjected to asymmetrical side loading.

The stabilizer unit 106 does not include lower racks. The absence of these components reduces the cost of this unit. Thus, bed 104 of this version of the invention offers a litter 14 that is stabilized against the discomforting side-to-side rocking motion and is very economical to manufacture.

The above detailed description has been limited to specific embodiments of the invention. It will be apparent, however, that variations and modifications can be made to the invention with the attainment of some or all of the advantages thereof. Initially, it should be recognized that while the described version of the invention is a hospital bed design to provide support for the patient for an extended period of time, the invention has other patient support applications. The stabilizing advantages of this invention could, for example, be incorporated into a stretcher designed to provide short term support for the patient as he/she is moved from one location to another. Moreover, the invention could be integrated into a surgical table that serves as a support for the patient when a medical procedure is being preformed on him/her. It should of course be recognized that these tables, unlike beds and stretchers, typically are not provided with mobile bases. Furthermore, it should also be understood that some surgical tables are provided with litters that are designed so that only a portion thereof move relative to the base. For example, only the fowler portion, the upper body portion, of a surgical table may move. It may still be desirable to provide these tables with the features of this invention.

Also, while in the disclosed versions of the invention, the hospital beds have two stabilizing units 20 or 106, it should be clear that in other versions of the invention it may only be necessary to provide a single stabilizing unit to eliminate the undesirable side-to-side rocking. Furthermore, while the depicted lift assembly 16 is shown having two jacks 18, it should of course be recognized that hospital bed may have other types of lift assemblies such as a single center located jack and/or a pantograph style lifting unit. Thus it may be desirable to provide the bed with lift assemblies that include telescoping members that are screw fitted to each other. With respect to this version of the invention it is noted that, in the past it has been considered desirable to provide each end of the bed with two telescoping screw assemblies so that each pair of assemblies could work in tandem to stabilize the associated end of the litter. With this invention, it is now necessary to provide only a single telescoping screw assembly since other elements of the invention cooperate to stop litter instability.

Moreover, the stabilizing units may have structures different than what has been illustrated. For example, while in the depicted version of the invention the individual rack-and-pinion units forming the stabilizing unit are symmetrically located around the longitudinal axis of the hospital bed and on the same side of the bed, in other versions of the invention units may be located in alternative locations. For example, it may be desirable to position the rack-and-pinion assemblies so that they are not symmetrically oriented around the longitudinal axis of the bed. In some versions of the invention it may even be desirable to position the stabilizing unit so that both rack-and-pinion assemblies are located on the same side of the bed 10. Such positioning may be desired to accommodate the placement of other components on the bed on the base 12. Furthermore, in regard to the single rack version of the invention described with respect to FIG. 10, there is no requirement that the pinion always be associated with the base 12 and the racks with the litter 14; the arrangement of these components can be reversed. Also the individual components of the bed can be modified as necessary. For instance, in some preferred versions of the invention the load cells 42 that couple the jacks 18 to the litter 14 may have main bodies with generally rectangular profiles. Therefore, it is the object of the appended claims to cover all such variations and modifications as come within the true spirit and scope of the invention.

The embodiments of the invention in which an exclusive property or privilege is claimed are defined as follows:

1. A hospital bed including:

a base having a head end and a foot end distal from said head end;

a litter disposed on said base, said litter having a surface on which a patient can rest, a head end adjacent said base head end and a foot end adjacent said base foot end;

a lift assembly connected between said base and said litter for vertically positioning said litter a selected distance above said base, said lift assembly having a drive unit that provides motive power for vertically positioning said litter; and at least one stabilizing unit connected between a section of said litter and said base, said at least one stabilizing unit including two spaced apart rack-and-pinion assemblies connected between said litter and said base, each said rack-and-pinion assembly having a lower rack that extends upwardly from said base, an upper rack that is suspended from said litter and positioned to at least partially oppose said lower rack, and a pinion positioned between said upper rack and said lower rack and further positioned to engage said upper rack and said lower rack so that as said racks shift vertically relative to each other, said pinion rotates and moves vertically relative to said base, and a connecting member extending between said pinions so as to cause said pinions to rotate in unison and to simultaneously shift position relative to said base so as to prevent said upper racks from moving in opposite directions relative to said lower racks so as to prevent uneven movement of the section of said litter to which said upper racks are attached relative to said base, wherein said connecting member is not directly connected to said drive unit of said lift assembly for receiving motive power.

2. The hospital bed of claim 1, further including two said stabilizing units, said stabilizing units being attached to opposed ends of said base.

3. The hospital bed of claim 1, further including separate housings disposed over each said pinion, each said housing being formed with openings through which said associated upper and lower racks extend.

4. The hospital bed of claim 3, wherein said rack-and-pinion pinion housings are formed from two identically-shaped housing plates.

5. The hospital bed of claim 1, wherein said lift assembly is configured to position said opposed ends of said litter at different vertical locations relative to said base so that said litter can be placed in an inclined position.

6. The hospital bed of claim 2, wherein said lift assembly is configured to position said opposed ends of said litter at different vertical locations relative to said base so that said litter can be placed in an inclined position.

7. The hospital bed of claim 4, wherein said lift assembly is configured to position said opposed ends of said litter at different vertical locations relative to said base so that said litter can be placed in an inclined position.

8. The hospital bed of claim 1, wherein said litter has a longitudinal axis and said rack-and-pinion assemblies are located on opposed sides of said litter longitudinal axis.

9. The hospital bed of claim 1, wherein said litter has a longitudinal axis and said rack and pinion assemblies are symmetrically located on opposed sides of said litter longitudinal axis.

10. The hospital bed of claim 1, wherein said base is a mobile unit.

11. A hospital bed including:

a base having a head end and a foot end distal from said head end;

a litter disposed on said base, said litter having a surface on which a patient can rest, a head end adjacent said base head end, a foot end adjacent said base foot end and a longitudinal axis;

a lift assembly connected between said base and said litter for vertically positioning at least one end of said litter a selected distance above said base, said lift assembly having a drive unit for providing motive power for vertically positioning said litter; and a first pair of rack-and-pinion assemblies attached to one said end of said litter and to said adjacent end of said base so that each said rack-and-pinion assembly is located on a separate side of said litter longitudinal axis, each said rack-and-pinion assembly including a first rack attached to said litter that extends downwardly from said litter, a second rack attached to said base that extends upwardly from said base, said racks being formed with toothed surfaces and being positioned so that said rack toothed surfaces are adjacent each other, and a pinion disposed between said first and second racks for engaging said toothed surfaces of said racks so that said pinion moves along said lower rack with the vertical displacement of said litter; and a transverse linkage extending between said pinions across said longitudinal axis of said litter for connecting said pinions so that said pinions rotate in unison and when said litter moves relative to said base, said transverse linkage moves relative to said base wherein said transverse linkage is not directly connected to said drive unit of said lift assembly for receiving motive power therefrom.

12. The hospital bed of claim 11, wherein said first and second racks are identical in shape and size.

13. The hospital bed of claim 12, wherein said first racks are connected to said litter by extender tubes that extend downward from said litter.

14. The hospital bed of claim 11, further including separate housings disposed over each said pinion, each said housing being formed with openings through which said associated upper and lower racks extend and being constructed out of two identically-shaped housing plates.

15. The hospital bed of claim 11, wherein said litter assembly is connected between said base and said litter for vertically positioning both ends of said litter a selected distance above said base.

16. The hospital bed of claim 15, further including a second said pair of rack-and-pinion assemblies attached to said base and said litter such that one pair of said rack-and-pinion assemblies is attached to each end of said litter and the associated end of said base, each said second pair rack-and-pinion assembly including a first rack attached to said litter that extends downwardly from said litter, a second rack attached to said base that extends upwardly from said base, said racks being formed with toothed surfaces and being positioned so that said rack toothed surfaces are adjacent each other, and a pinion disposed between said first and second racks for engaging said toothed surfaces of said racks; and a second transverse linkage extending between said second pair rack-and-pinion assembly pinions across said longitudinal axis of said litter for connecting said pinions so that said pinions rotate in unison wherein said second transverse linkage is not directly connected to said drive unit of said lift assembly for receiving motive power therefrom.

17. The hospital bed of claim 1, wherein said lift assembly includes at least one rigid arm connected between said base and said litter that is movable between a retracted position and an extended position for positioning said litter relative to said base and said drive unit is connected to said at least one rigid arm for moving said at least one rigid arm between said retracted and extended positions.

18. The hospital bed of claim 17, wherein said lift assembly drive unit is a hydraulic drive unit coupled to said at least one rigid arm.

19. The hospital bed of claim 17, wherein said lift assembly at least one rigid arm is positioned to move along a path of travel between said retracted and extended positions that is substantially perpendicular to said base.

20. The hospital bed of claim 19, wherein said lift assembly is a hydraulic jack having a base unit and a movable piston that extends upward from said base unit to function as said at least one rigid arm.

21. The hospital bed of claim 17, wherein said lift assembly includes two said rigid arms, each said rigid arm being connected to a separate said end of said base and each said rigid arm being independently movable between said retracted and extended positions so that by selective displacement of said rigid arms, said litter can be moved into an inclined position.

22. A hospital bed of claim 11, wherein said lift assembly includes at least one rigid arm connected between said base and said litter that is movable between a retracted position and an extended position for positioning said litter relative to said base and said drive unit is connected to said at least one rigid arm for moving said at least one rigid arm between said retracted and extended positions.

23. The hospital bed of claim 22, wherein said lift assembly drive unit is a hydraulic drive unit coupled to said at least one rigid arm.

24. The hospital bed of claim 22, wherein said lift assembly at least one rigid arm is positioned to move along a path of travel between said retracted and extended positions that is substantially perpendicular to said base.

25. The hospital bed of claim 24, wherein said lift assembly is a hydraulic jack having a base unit and a movable piston that extends upwards from said base unit to function as said at least one rigid arm.

26. The hospital bed of claim 22, wherein said lift assembly includes two said rigid arms, each said rigid arm being connected to a separate said end of said base and each said rigid arm being independently movable between said retracted and extended positions so that by selective displacement of said rigid arms, said litter can be moved into an inclined position.

* * * * *